US006718720B1

(12) United States Patent
Doppler

(10) Patent No.: US 6,718,720 B1
(45) Date of Patent: Apr. 13, 2004

(54) FLOORING SYSTEM AND METHOD

(75) Inventor: Gregory E. Doppler, Loveland, OH (US)

(73) Assignee: Cornerstone Specialty Wood Products Inc., Cincinnati, OH (US)

( * ) Notice: Subject to any disclaimer, the term of this patent is extended or adjusted under 35 U.S.C. 154(b) by 0 days.

(21) Appl. No.: 10/262,771

(22) Filed: Oct. 2, 2002

(51) Int. Cl.[7] ..... E04C 3/00

(52) U.S. Cl. ..... 52/578; 52/783.19; 52/783.18; 52/783.17; 52/783.11; 52/506.05; 411/501

(58) Field of Search ..... 52/783.19, 783.18, 52/783.17, 783.11, 506.05, 578; 411/501

(56) References Cited

U.S. PATENT DOCUMENTS

| | | | | |
|---|---|---|---|---|
| 4,706,319 | A | * 11/1987 | Sivachenko et al. | 14/73 |
| 5,088,259 | A | * 2/1992 | Myers | 52/410 |
| 5,584,153 | A | * 12/1996 | Nunley et al. | 52/410 |
| 5,612,117 | A | * 3/1997 | Belanger et al. | 428/178 |
| 5,661,937 | A | * 9/1997 | Doppler et al. | 52/410 |
| 5,802,780 | A | 9/1998 | Hammerschlag | |
| 6,065,918 | A | * 5/2000 | Adams | 411/29 |
| 6,108,998 | A | * 8/2000 | Dumlao | 52/783.17 |
| 6,233,896 | B1 | 5/2001 | Coup | |
| 2001/0015042 | A1 | 8/2001 | Ballard | |
| 2002/0006321 | A1 | 1/2002 | Singh et al. | |

OTHER PUBLICATIONS

Resinflor Installation Instructions, Cornerstone Specialty Wood Products Inc. instruction sheet.

Specification Sheet—Resinflor Over Corrugated Metal Roof Deck, Cornerstone Specialty Wood Products instruction sheet.

Product Description—Resinflor Panels, Cornerstone Specialty Wood Products information sheet.

* cited by examiner

*Primary Examiner*—Carl D. Friedman
*Assistant Examiner*—Steve Varner
(74) *Attorney, Agent, or Firm*—Thompson Hine LLP

(57) ABSTRACT

A flooring system includes a first floor member having a through hole and includes a second floor member having a non-through hole which extends from the bottom side toward the top side of the second floor member. The second floor member is positioned above the first floor member with the non-through hole aligned with the through hole. A radially-expandable fastener (such as a rivet) extends through the through hole and into the non-through hole. A method for installing a flooring system includes obtaining a first floor member having a through hole, obtaining a second floor member, and positioning the second floor member above the first floor member. A non-through hole is created extending from its bottom side toward its top side. A radially-expandable fastener (such as a rivet) is installed in the first and second floor members. The radially-expandable fastener extends through the through hole and into the non-through hole.

10 Claims, 3 Drawing Sheets

FLOORING SYSTEM AND METHOD

TECHNICAL FIELD

The present invention relates generally to floors, and more particularly to a flooring system and to a method for installing a flooring system.

BACKGROUND OF THE INVENTION

Conventional flooring systems include flooring systems installed on a grid-like flooring support. Conventional home flooring systems include those having a plywood substrate attached by nails from above to a floor-joist flooring support wherein tongue-and-groove hardwood floor panels are attached by nails from above to the plywood substrate. Conventional mezzanine flooring systems provide one or more floor levels between the main floor and the main ceiling and are used, for example, in warehouses. The mezzanine floor is used by people and carts or pallet jacks to store goods on, and remove goods from, one or more shelf levels accessible from the mezzanine floor.

A known mezzanine flooring system includes corrugated metal roof decking ("B" deck) attached to a structural mezzanine substructure or a rack flooring support at a height above a main floor wherein tongue-and-groove wood-product flooring panels are attached by screws from above to the corrugated metal roof decking. If the screw head protrudes above the top surface of the wood-product flooring panel, a tripping hazard is created. If the screw head is countersunk in the top surface of the wood-product flooring panel, a dirt-collector recess is created.

One known alternate attachment uses screws from underneath the corrugated metal roof decking wherein the screws are screwed through the corrugated metal roof decking and into the wood-product flooring panels without penetrating the top side in-the wood-product flooring panels. Such underneath screw attachment provides a smooth top surface for the wood-product flooring panels but, such panels can become loose due to foot and cart traffic on the top side of the wood-product flooring panels. Screwing through corrugated metal roof decking from underneath the metal decking creates falling hot metal shavings which pose a safety concern to the installers. The screw tip provides no holding power. Screws are difficult to install properly. Misalignment of the screw lessens its holding power in the floor panel. Failure to seat the screw head on the underside of the metal decking fails to create a rigid attachment of the floor panel to the metal decking. Spinning the screw excessively while seated on the underside of the metal decking removes wood from the flooring panels lessening the screws holding power in the floor panel. Weight must be applied to the top of the floor panel for the installation of each screw. Topside screwing into the floor panel deforms the floor panel at the screw hole preventing reuse of the floor panel.

What is needed is an improved flooring system and an improved method for installing a flooring system.

SUMMARY OF THE INVENTION

A first expression of an embodiment of the invention is for a flooring system and includes a first floor member, a second floor member, and a radially expandable fastener (such as a rivet). The first floor member has a lower surface and an upper surface and has a through hole extending from the lower surface to the upper surface. The second floor member has a bottom side and a top side and has a non-through hole extending from the bottom side toward the top side. The second floor member is positioned above the first floor member with the non-through hole aligned with the through hole. The radially-expandable fastener (such as a rivet) extends through the through hole and into the non-through hole securing the second floor member to the first floor member.

A first method of the invention is for installing a flooring system and includes steps a) through e). Step a) includes obtaining a first floor member having a lower surface and an upper surface and having a through hole extending from the lower surface to the upper surface. Step b) includes obtaining a second floor member having a bottom side and a top side. Step c) includes positioning the second floor member above the first floor member. Step d) includes creating a non-through hole extending from the bottom side toward the top side of the second floor member. Step e) includes installing a radially-expandable fastener (such as a rivet) in the first and second floor members, wherein the radially-expandable fastener (such as a rivet) extends through the through hole and into the non-through hole securing the second floor member to the first floor member.

Several benefits and advantages are derived from the first expression of an embodiment and/or the first method of the invention. In the rivet embodiment of the radially-expandable fastener with a metal embodiment of the first floor member and a non-metal embodiment of the second floor member, the barrel of the installed rivet is circumferentially expanded over its uninstalled state to radially engage the wall of the non-through hole of the second floor member and the head of the installed rivet longitudinally engages the lower surface of the first floor member which secures the second floor member to the first floor member in a strong and durable attachment which is able to withstand floor traffic from people, carts, and pallet jacks on the top side of the second floor member. The use of a blind rivet from underneath the first and second floor members leaves the secured second floor member with a smooth top surface without any protruding tripping hazards and without any dirt-collecting recesses.

Installation of the radially-expandable fastener does not create falling hot metal shavings. In the rivet embodiment, the complete length of the barrel of the rivet provides holding power, the rivets are easy to install properly without misalignment and without under or over installation problems. Weight is applied to the top of the floor panel for the installation of only a few rivets to seat the second floor panel. The rivets do not pierce the top surface of the second floor member allowing for reuse of the second floor member.

DESCRIPTION OF THE PREFERRED EMBODIMENTS

Figure 1:
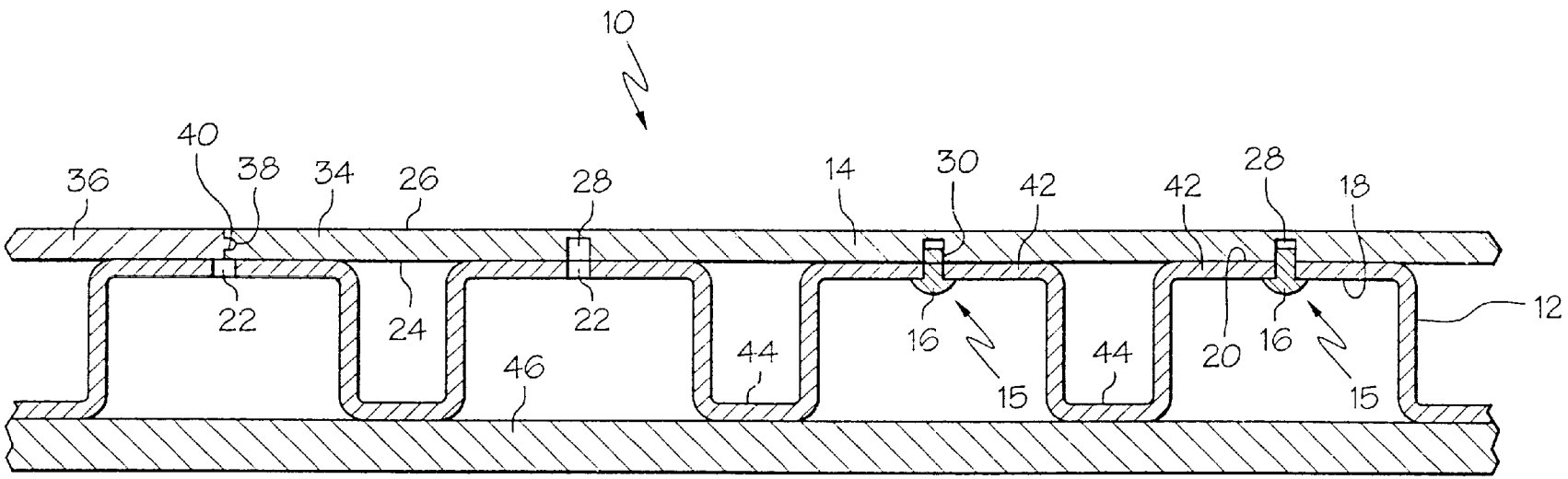
FIG. 1 is a cross-sectional elevational view of an embodiment of the invention showing the rivet attachment of the first flooring panel of the second floor member to the first floor member with the first floor member positioned on a flooring support and also showing a second flooring panel.
Figure 2:
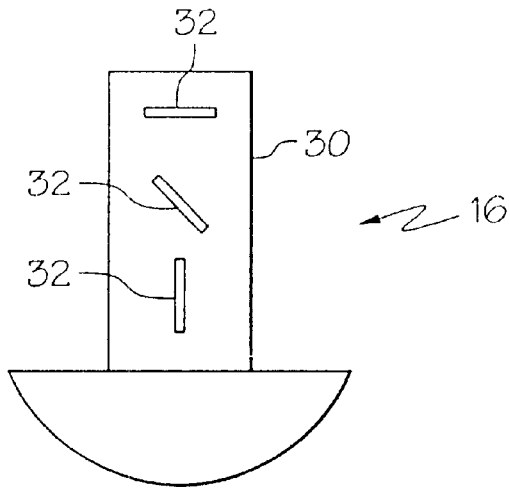
FIG. 2 is an elevational view of one of the rivets of FIG. 1 showing the surface roughness of the outer circumferential surface of the rivet.
Figure 3:
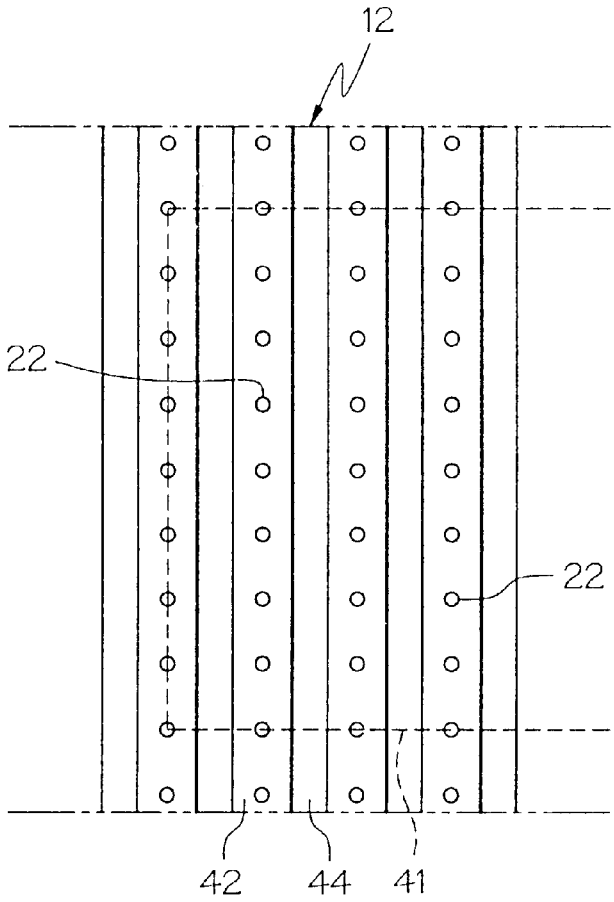
FIG. 3 is a top planar and larger-area view of the first floor member of FIG. 1 showing the pattern of through holes in the first floor member and also showing a dashed-line outline of where the first flooring panel of the second floor member would be overlaid on top of the first floor member.

Referring now to the drawings, FIGS. 1–3 illustrate an embodiment of the present invention. A first expression of the embodiment shown in FIGS. 1–3 is for a flooring system 10 including a first floor member 12, a second floor member 14, and a radially-expandable fastener 15. The first floor member 12 has a lower surface 18 and an upper surface 20 and has a through hole 22 extending from the lower surface 18 to the upper surface 20. The second floor member 14 has a bottom side 24 and a top side 26 and has a non-through hole 28 extending from the bottom side 24 toward the top side 26. The second floor member 14 is disposed above the first floor member 12 with the non-through hole 28 aligned with the through hole 22. The radially-expandable fastener 15 extends through the through hole 22 and into the non-through hole 28 securing the second floor member 14 to the first floor member 12.

One example of a radially-expandable fastener 15 is a rivet 16. One known rivet includes three longitudinal barrel slots which split creating three legs when the rivet is set. Other examples of radially-expandable fasteners are left to the artisan. The following description of the first embodiment uses a rivet as an example of the radially-expandable fastener.

It is pointed out that FIG. 1 shows, from left to right, a through hole 22 aligned underneath a joint edge of the second floor member 14, a non-through hole 28 aligned with its corresponding through hole 22 before the installation of a rivet, and two installed rivets 16 extending through their corresponding through holes and into their corresponding aligned non-through holes, as can be understood by those skilled in the art.

It is noted that since the hole of the second floor member 14 is a non-through hole 28, the rivet 16 is a blind rivet and does not extend to the top side 26 of the second floor member 14. In one application, the top side 26 is exposed to floor traffic of people and/or carts and has a smoothness devoid of tripping-hazard protrusions and dirt-collecting recesses. The flooring system 10 can be used anywhere permitting its installation such as (without limitation) as a mezzanine floor, as can be appreciated by the artisan.

In one example of the first expression of the embodiment of FIGS. 1–3, the rivet 16 includes, as best seen in FIG. 2, an outer circumferential surface 30 having a surface roughness which is detectable to the finger touch of an average person. In one variation, a hacksaw is used to create score marks 32 on the circumferential surface 30 to produce a desired surface roughness. Other ways of creating the surface roughness and the resulting particular (random or predetermined) three-dimensional surface-roughness map of the circumferential surface 30 are left to the artisan. Applicant found, in a pull-apart destruction test, that it took three times the force to pull the rivet out of a second floor member when a rivet having surface roughness was installed compared to when a conventional smooth-surfaced rivet was installed.

In one implementation, the flooring system 10 also includes additional rivets 16 extending through additional through holes 22 of the first floor member 12 and into additional aligned non-through holes 28 of the second floor member 14.

In one construction, the second floor member 14 includes a first flooring panel 34 having a first edge, and the flooring system 10 also includes a second flooring panel 36 having a second edge. In this construction, the first and second flooring panels 34 and 36 are disposed with the first edge adjacent the second edge. In one variation, the first edge includes a tongue portion 38 and the second edge includes a groove portion 40, and the tongue portion 38 is disposed in the groove portion 40. FIG. 3 shows a dashed-line outline 41 of one placement of where the first flooring panel 34 would be placed over (and in one example on) the first floor member 12.

In the same or a different construction, the first floor member 12 includes substantially-parallel ribs 42 and valleys 44. In one design, the tops of the ribs 42 lie in a common plane. In one modification, the rivet 16 extends through one of the ribs 42 of the first floor member 12. In one variation, at least one of the valleys 44 of the first floor member 12 is attached to a flooring support 46. In one installation, the panels are disposed so that the joints break on different ribs wherever possible. In one usage, the flooring system 10 is a mezzanine flooring system wherein the flooring support 46 is a bar joist or other structural member supported on a main floor (not shown) and wherein the first floor member 12 is attached to the bar joists of the rack ten or more feet above the main floor using teks, pins, welding, etc. Other usages are left to the artisan.

In one choice of materials, the first floor member 12 consists essentially of metal, and the second floor member 14 consists essentially of non-metal. In one variation, the first floor member 12 includes corrugated metal roof decking (such as "B" deck). In the same or a different variation, the second floor member 14 comprises a wood product such as plywood, polydeck, fiberboard, oriented strand board, comply, or particleboard. In one modification, the second floor member 14 comprises plastic such as plastic lumber. One choice for the second floor member 14 is a Resinflor™ panel which is a blend of phenolic or isocyanurate resins, a wax emulsifier, and wood fibers combined under heat and pressure and which is available from Cornerstone Specialty Wood Products Inc. of Cincinnati, Ohio.

In one application, not shown, the first floor member is a metal bar joist having a right-angle bend, and the second floor member is a non-metal member disposed above and on the right-angle bend of the bar joist. In one variation, the non-metal member is a plywood member up to one and one-half inches thick, and the radially-expandable fastener is a rivet. The arrangement of the bar joists is left to the artisan.

Figure 4:
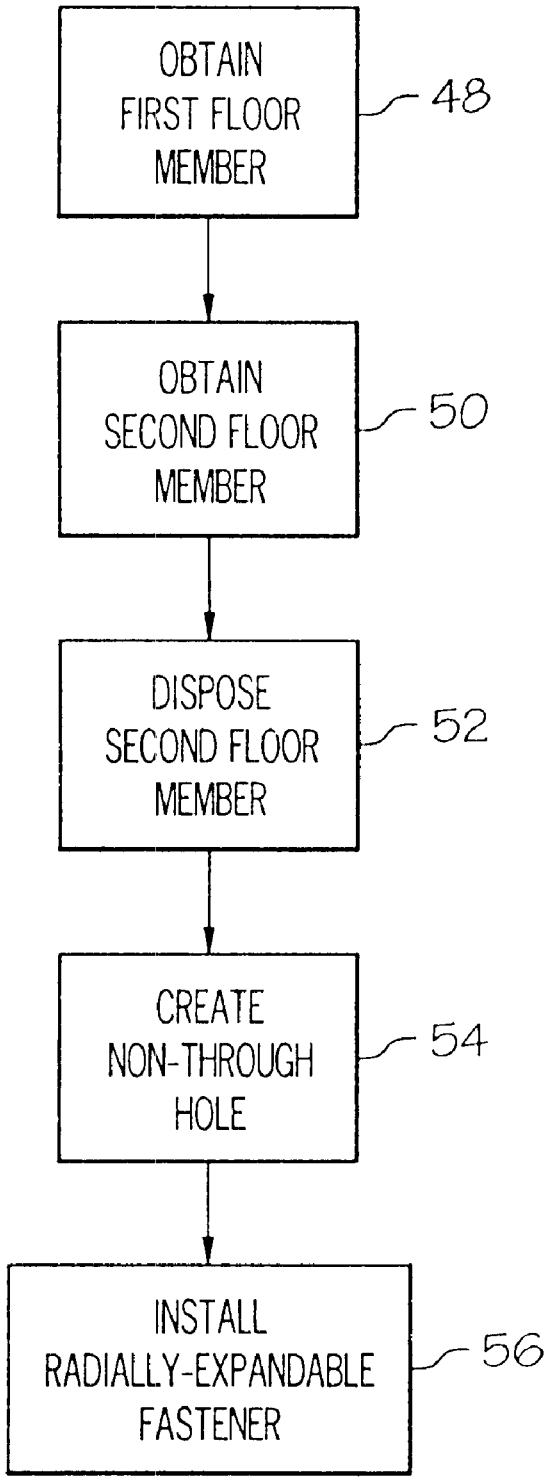
FIG. 4 is a block diagram of a first method of the invention for installing a flooring system.

A first method of the invention is for installing a flooring system 10. The method is shown in block diagram form in FIG. 4 and includes steps a) through e). Step a) is labeled as "Obtain First Floor Member" in block 48 of FIG. 4. Step a) includes obtaining a first floor member 12 having a lower surface 18 and an upper surface 20 and having a through hole 22 extending from the lower surface 18 to the upper surface 20. Step b) is labeled as "Obtain Second Floor Member" in block 50 of FIG. 4. Step b) includes obtaining a second floor member 14 having a bottom side 24 and a top side 26. Step c) is labeled as "Dispose Second Floor Member" in block 52 of FIG. 4. Step c) includes disposing the second floor member 14 above the first floor member 12. Step d) is labeled as "Create Non-Through Hole" in block 54 of FIG. 4. Step d) includes creating a non-through hole 28 extending from the bottom side 24 toward the top side 26 of the second floor member 14. Step e) is labeled as "Install Radially-Expandable Fastener" in block 56 of FIG. 4. Step e) includes installing a radially-expandable fastener 15 in the first and second floor members 12 and 14, wherein the radially-expandable fastener 15 extends through the through hole 22 and into the non-through hole 28 securing the second floor member 14 to the first floor member 12.

One example of a radially-expandable fastener 15 is a rivet 16. Other examples of radially-expandable fasteners are left to the artisan. The following description of the first method uses a rivet as an example of the radially-expandable fastener.

In one extension of the first method, the first floor member 12 obtained in step a) includes additional through holes 22, and step d) creates additional non-through holes 28 in the second floor member 14. In this extension; step e) installs additional rivets 16 through the additional through holes 22 and into the aligned non-through holes 28, as can be appreciated by the artisan. In one execution of the first method, the rivets 16 are installed using a pneumatic, hydraulic, electric, or battery-powered rivet gun.

In one implementation of the first method, a pattern of through holes 22 (which may be many more than will be used by a particular choice of rivet placement) is pre-drilled in the first floor member 12 before the first floor member 12 is shipped to the installation site for the flooring system 10. In another implementation, the holes 22 are drilled at the installation site.

In one enablement of the first method, step c) disposes the second floor member 14 on the first floor member 12, and step d) is performed entirely with the second floor member 14 disposed above and on the first floor member 12. In one variation, step d) uses a drill having a drill bit, wherein during step d) the drill is disposed beneath the first floor member 12, and wherein during step d) the drill bit is disposed in the through hole 22 of the first floor member 12. In this variation, weight would be applied on top of the second floor member 14 during the drilling. Other ways and locations for performing step d), and other sequences for performing the steps of the firs method, are left to the artisan.

In one example of the first method, there is also included, before step e), the step of creating a surface roughness, which is detectable to the finger touch of an average person, on the outer circumferential surface 30 of the rivet. In one variation, as previously mentioned, a hacksaw is used to create score marks 32 on the circumferential surface 30 to produce a desired surface roughness. In another variation, machine-shop knurling, or other methods, provide surface deformations in the barrel of the rivet prior to the manufacture of the rivet. Other ways of creating the surface roughness and the resulting particular (random or predetermined) three-dimensional surface-roughness map of the circumferential surface 30 are left to the artisan.

In one application of the first method, the second floor member 14 includes a first flooring panel 34 having a first edge, and the first method also includes the steps of obtaining a second flooring panel 36 having a second edge and disposing the first and second flooring panels with the first edge adjacent the second edge. In one variation, gapping shims are temporarily placed between the edges to position the flooring panels before the rivet 16 is installed to avoid surface buckling of the flooring panels due to linear expansion of the panels caused by extreme humidity, as can be appreciated by those skilled in the art. The temporary gapping shims are removed after the flooring panels are secured to the first floor member. In one procedure, no rivet 16 is installed more than 6 inches away from an edge. In one modification, the first method includes the step of obtaining additional first floor members 12 which, together with the original first floor member 12 provide a support for the second floor member 14 and any additional second floor members 14 (such as for the first and second flooring panels 34 and 36).

In one design used in performing the first method, the first floor member 12 includes substantially-parallel ribs 42 and valleys 44, and step e) installs the rivet 16 in one of the ribs 42 of the first floor member 12. In one variation, the first method also includes the step of disposing a permanent shim (not shown) on the first floor member 12 spanning a valley 44 when the first and second edges of the first and second flooring panels 34 and 36 are disposed over the valley. In one modification, the first method also includes the step of attaching at least one of the valleys 44 of the first floor member 12 to a flooring support 46.

In one practice of the first method, using tongue-and-groove flooring panels, the position of the tongue-and-groove joints are located from underneath the first floor member. As flooring panels are laid on top of the first floor member and gapped with gapping shims, topside installers hammer a punch mark (with a center punch) on the first floor member at the position where the tongue-and-groove of the next panel joint would occur. This mark, made on either a rib or a valley, can be seen from below by underside installers. This allows the underside installers to locate the rivets at proper distances from the tongue-and-groove joint and establish the proper pattern and alignment of the rivets from the underside.

In one choice of materials for the first floor member, the first floor member 12 obtained in step a) includes corrugated metal roof decking such as 18 or 20 gauge galvanized steel "B" decking. In one variation, the decking is laid down in substantially 36 inch widths, the distance between the centers of neighboring ribs is substantially 6 inches, each rib is substantially 3 ½ inches wide, and the through holes 22 are pre-punched along the centers of the ribs substantially 6 inches apart and have an unexpanded diameter of substantially 17/64-inch. In one choice of materials for the second floor member, the second floor member 14 obtained in step b) comprises a wood Product. In one variation, the second floor member 14 includes a substantially ¾-inch thick 4-foot by 8-foot Resinflor™ panel. In one modification, the non-through holes 28 are substantially 11/16-inch deep and have an unexpanded diameter of substantially 17/64-inch. In one execution of the first method, the panels are installed with their long direction parallel or perpendicular to the corrugated metal "B"-deck. In one installation, 24 rivets are used which are arranged in 3 rows of 8 rivets each. In one choice of materials for the rivet, the uninstalled, rivet 16 is a dome rivet having a steel rivet and steel mandrel such as rivet number RV6977-8-4 available from GESIPA Fasteners USA, Inc., wherein the rivet has an unexpanded outside diameter of substantially ¼-inch and an expanded diameter of substantially 5/16-inch.

Applicant tested an example of the flooring system 10. Over 50,000 cycles of simulated repeat pallet jack wheel traffic were run at the design load for three different grades of Resinflor™ panels to simulate over 12 years of pallet jack traffic with the equivalent of 1500, 2500, and 4000 pounds on a pallet jack. There were no rivet or panel failures.

Several benefits and advantages are derived from the first expression of an embodiment and/or the first method of the invention. In the rivet embodiment of the radially-expandable fastener with a metal embodiment of the first floor member and a non-metal embodiment of the second floor member, the barrel of the installed rivet is circumferentially expanded over its uninstalled state to radially engage the wall of the non-through hole of the second floor member and the head of the installed rivet longitudinally engages the lower surface of the first floor member which secures the second floor member to the first floor member in a strong and durable attachment which is able to withstand floor traffic from people, carts, and pallet jacks on the top side of the second floor member. The use of a blind rivet from underneath the first and second floor members leaves the secured second floor member with a smooth top surface without any protruding tripping hazards and without any dirt-collecting recesses.

Installation of the radially-expandable fastener does not create falling hot metal shavings. In the rivet embodiment, the complete length of the barrel of the rivet provides holding power, the rivets are easy to install properly without misalignment and without under or over installation problems. Weight is applied to the top of the floor panel for the installation of only a few rivets to seat the second floor panel. The rivets do not pierce the top surface of the second floor member allowing for reuse of the second floor member. Optionally imparting a surface roughness to the rivet before installing the rivet significantly increased the holding power of the installed rivet.

The foregoing description of a first expression of an embodiment of the invention and of a first method of the invention has been presented for purposes of illustration. It is not intended to be exhaustive or to limit the invention to the precise forms and steps disclosed, and obviously many modifications and variations are possible in light of the above teaching. It is intended that the scope of the invention be defined by the claims appended hereto.

What is claimed is:

1. A method for installing a flooring system comprising the steps of:

a) obtaining a first floor member having a lower surface and an upper surface and having a through hole extending from the lower surface to the upper surface;

b) obtaining a second floor member having a bottom side and a top side;

c) disposing the second floor member above the first floor member;

d) creating a non-through hole extending from the bottom side toward the top side of the second floor member; and e) installing a radially-expandable fastener in the first and second floor members, wherein the radially-expandable fastener extends through the through hole and into the non-through hole securing the second floor member to the first floor member.

2. The method of claim 1, wherein the radially-expandable fastener is a rivet.

3. The method of claim 2, wherein step c) disposes the second floor member on the first floor member, and wherein step d) is performed entirely with the second floor member disposed above and on the first floor member.

4. The method of claim 3, wherein step d) uses a drill having a drill bit, wherein during step d) the drill is disposed beneath the first floor member, and wherein during step d) the drill bit is disposed in the through hole of the first floor member.

5. The method of claim 2, also including, before step e), the step of creating a surface roughness, which is detectable to the finger touch of an average person, on the outer circumferential surface of the rivet.

6. The method of claim 2, wherein the second floor member includes a first flooring panel having a first edge, and wherein the method also includes the steps of obtaining a second flooring panel having a second edge and disposing the first and second flooring panels with the first edge adjacent the second edge.

7. The method of claim 6, wherein the first floor member includes substantially-parallel ribs and valleys, and wherein step e) installs the rivet in one of the ribs of the first floor member.

8. The method of claim 7, also including the step of disposing a shim on the first floor member spanning a valley when the first and second edges of the first and second flooring panels are disposed over the valley.

9. The method of claim 8, also including the step of attaching at least one of the valleys of the first floor member to a flooring support.

10. The method of claim 2, wherein the first floor member obtained in step a) includes corrugated metal roof decking, and wherein the second floor member obtained in step b) comprises a wood product.

* * * * *